US007088043B2

(12) United States Patent
Min et al.

(10) Patent No.: US 7,088,043 B2
(45) Date of Patent: Aug. 8, 2006

(54) PLASMA DISPLAY PANEL ENHANCING A BRIGHT ROOM CONTRAST

(75) Inventors: Jong-Sul Min, Hwasung-si (KR); Chang-Wan Hong, Yongin-si (KR); Young-Sun Kim, Suwon-si (KR); Young-Soo Han, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/070,082

(22) Filed: Mar. 3, 2005

(65) Prior Publication Data

US 2005/0225239 A1 Oct. 13, 2005

(30) Foreign Application Priority Data

Apr. 9, 2004 (KR) ..... 10-2004-0024509

(51) Int. Cl.
*H01J 17/49* (2006.01)

(52) U.S. Cl. ..... 313/586; 313/582; 313/587

(58) Field of Classification Search ..... 313/582, 313/586, 587
See application file for complete search history.

(56) References Cited

U.S. PATENT DOCUMENTS

| | | | | |
|---|---|---|---|---|
| 4,731,558 | A * | 3/1988 | Haisma et al. | 313/478 |
| 5,939,826 | A * | 8/1999 | Ohsawa et al. | 313/582 |
| 6,417,619 | B1 * | 7/2002 | Yasunori et al. | 313/582 |
| 6,417,620 | B1 * | 7/2002 | Yasue | 313/587 |
| 6,437,507 | B1 * | 8/2002 | Ha | 313/587 |
| 6,531,817 | B1 * | 3/2003 | Holtslag et al. | 313/582 |
| 6,670,754 | B1 * | 12/2003 | Murai et al. | 313/582 |
| 6,787,976 | B1 * | 9/2004 | Minoura et al. | 313/110 |
| 6,833,667 | B1 * | 12/2004 | Hamano et al. | 313/504 |
| 2004/0212305 | A1 * | 10/2004 | Fujitani et al. | 313/586 |

FOREIGN PATENT DOCUMENTS

| | | |
|---|---|---|
| JP | 64-035648 | 2/1989 |
| JP | 2001-154597 | 6/2001 |
| JP | 2002-174703 | 6/2002 |
| KR | 100236457 | 9/1999 |
| KR | 2003-073173 | 9/2003 |
| WO | 00-39830 | 7/2000 |

* cited by examiner

*Primary Examiner*—Joseph Williams
*Assistant Examiner*—Peter Macchiarolo
(74) *Attorney, Agent, or Firm*—Roylance, Abrams, Berdo & Goodman, LLP

(57) ABSTRACT

A plasma display panel (PDP) is provided. The plasma display panel comprises a lower substrate and an upper substrate spaced apart by a predetermined distance, forming a discharge space; a plurality of barrier ribs between the lower substrate and the upper substrate, partitioning the discharge space to form a plurality of discharge cells; a plurality of address electrodes formed in parallel on the upper surface of the lower substrate; a plurality of discharge electrodes formed at an angle to the address electrodes on the lower surface of the upper substrate; a fluorescent layer formed on the inner wall of the discharge cells; and an external light shielding member formed on the upper substrate prevents external light from entering the discharge cells, wherein the upper substrate has a plurality of convex lenses parallel to the address electrodes, to focus generated visible light out of the PDP.

31 Claims, 6 Drawing Sheets

PLASMA DISPLAY PANEL ENHANCING A BRIGHT ROOM CONTRAST

CROSS-REFERENCE TO RELATED APPLICATION

This application claims the benefit under 35 U.S.C. §119 (a) of Korean Patent Application No. 10-2004-0024509, filed in the Korean Intellectual Property Office on Apr. 9, 2004, the entire disclosure of which is hereby incorporated by reference.

BACKGROUND OF THE INVENTION

1. Field of the Invention

The present invention relates to a plasma display panel. More particularly, the present invention relates to a plasma display panel with an improved structure that can enhance brightness and bright room contrast.

2. Description of the Related Art

A plasma display panel (PDP) is an apparatus to form an image using an electrical discharge. Its superior performance in terms of brightness and viewing angle has ensured its popularity. In such a PDP, a DC or AC voltage is applied to electrodes causing a gas discharge between the electrodes, and ultraviolet rays generated by the discharge excite a fluorescent material, which emits a visible light.

PDPs are classified as either a DC type or an AC type, according to the type of discharge. The DC type PDP has a structure in which all the electrodes are exposed to a discharge space, and charges move directly between the electrodes. The AC type PDP has a structure in which at least one electrode is covered with a dielectric layer, and charges do not move directly between the corresponding electrodes but discharge is performed by wall charges.

Also, PDPs may be classified as a facing discharge type or a surface discharge type, according to the arrangement of the electrodes. The facing discharge type PDP has a structure in which a pair of sustaining electrodes are formed respectively on a front substrate and a rear substrate, and discharge occurs perpendicular to the panel. The surface discharge type PDP has a structure in which a pair of sustaining electrodes are formed on the same substrate, and discharge occurs parallel to the panel.

Although it has a high luminous efficiency, the facing discharge type PDP has a, the disadvantage that its fluorescent layer can be deteriorated easily by plasma particles. For this reason, the surface discharge type PDP is presently more common.

FIGS. 1 and 2 show the construction of a general surface discharge type PDP. In FIG. 2, the upper substrate 20 is shown rotated by 90 degrees for easier understanding of the inner structure of the PDP.

Referring to FIGS. 1 and 2, the conventional PDP includes a lower substrate 10 and an upper substrate 20 facing each other.

On the upper surface of the lower substrate 10, a plurality of address electrodes 11 are arranged in a stripe configuration. The address electrodes 11 are covered by a white first dielectric layer 12. On the first dielectric layer 12, a plurality of barrier ribs 13 are formed at a predetermined spacing to prevent electrical and optical cross-talk between discharge cells 14. On the inner surfaces of discharge cells 14 partitioned by these barrier ribs 13, a red (R), green (G) and blue (B) phosphor layer 15 is coated to a predetermined thickness. The discharge cells 14 are filled with a discharge gas, which is a mixture of neon (Ne) and a small amount of xenon (Xe), as is generally used for plasma discharge.

The upper substrate 20 is a transparent substrate, which can transmit visible light, and may be formed of glass. The upper substrate 20 is coupled to the lower substrate 10 having the barrier ribs 13. On the lower surface of the upper substrate 20, sustaining electrodes 21*a* and 21*b* forming pairs and perpendicularly crossing the address electrodes 11 are arranged in a stripe configuration. The sustaining electrodes 21*a* and 21*b* are formed of a transparent conductive material, such as indium tin oxide (ITO), to transmit visible light. In order to reduce the line resistance of the sustaining electrodes 21*a* and 21*b*, bus electrodes 22*a* and 22*b* formed of metal are formed on the lower surfaces of the respective sustaining electrodes 21*a* and 21*b*, to a width less than that of the sustaining electrodes 21*a* and 21*b*. These sustaining electrodes 21*a* and 21*b* and the bus electrodes 22*a* and 22*b* are covered with a transparent second dielectric layer 23. Beneath the second dielectric layer 23, a protective layer 24 is formed. The protective layer 24 prevents the second dielectric layer 23 from damage by plasma sputtering, and emits secondary electrons, thereby lowering discharge voltage. The protective layer 24 is generally formed of magnesium oxide (MgO). A plurality of black stripes 30 are formed at a predetermined spacing, parallel to the sustaining electrodes 21*a* and 21*b*, on the upper surface of the upper substrate 20, to prevent external light from entering the panel.

The conventional PDP constructed as above generally uses a cycle of two operations: address discharge and sustaining discharge. The address discharge occurs between any one of the address electrodes 11 and any one of the sustaining electrodes 21*a* and 21*b*, and during the address discharge, wall charges are formed. The sustaining discharge is caused by a potential difference between the sustaining electrodes 21*a* and 21*b* positioned at the discharge cells 14 in which the wall charges are formed. During the sustaining discharge, the fluorescent layer 15 of the corresponding discharge cell is excited by ultraviolet rays generated from the discharge gas, thereby emitting visible light. The visible light emitted through the upper substrate 20 form the image.

However, when the conventional PDP constructed as above is used in a bright room condition, external light enters the discharge cells 14, mixing with the light generated by the discharge cells 14. This lowers the bright room contrast and reduces the image display performance of the PDP.

SUMMARY OF THE INVENTION

The present invention provides a PDP with better brightness and bright room contrast by improving the structure of an upper substrate.

According to an aspect of the present invention, there is provided a plasma display panel comprising a lower substrate and an upper substrate spaced apart from each other by a predetermined distance, and forming a discharge space therebetween; a plurality of barrier ribs between the lower substrate and the upper substrate, partitioning the discharge space to form a plurality of discharge cells; a plurality of address electrodes formed in parallel with one another on the upper surface of the lower substrate; a plurality of discharge electrodes formed at an angle to the address electrodes on the lower surface of the upper substrate; a fluorescent layer formed on the inner wall of the discharge cells; and an external light shielding member formed on the upper substrate, for preventing external light from entering the discharge cells, wherein the lower surface of the upper substrate has a plurality of cylindrical lenses, formed parallel to the address electrodes, to focus visible light generated in the discharge cells by discharge and emit the visible light to the outside.

The cylindrical lenses are preferably formed integral with the upper substrate, and each of the cylindrical lenses is preferably of a size corresponding to that of the discharge cells.

The discharge electrodes may be formed on the lower surfaces of the cylindrical lenses.

Alternatively, a transparent material layer may be formed to cover the lower surface of the cylindrical lenses, and the discharge electrodes may be formed on the lower surface of the transparent material layer.

The external light shielding member may comprise a plurality of stripes (preferably black) formed parallel to the address electrodes on the upper surface of the upper substrate. The stripes are formed where no visible light is emitted in the discharge cells. It is preferable that the stripes be placed equidistant from the center lines of the cylindrical lenses. The stripes may comprise a conductive film for shielding Electromagnetic Interference (EMI).

It is preferable that the upper surface of the upper substrate between the black stripes be non-glare treated.

It is preferable that the barrier ribs are formed parallel to the address electrodes.

A first dielectric layer covering the address electrodes may be formed on the upper surface of the lower substrate, and bus electrodes may be formed on the lower surfaces of the discharge electrodes.

A second dielectric layer covering the discharge electrodes may be formed on the lower surface of the upper substrate, and a protective layer may be formed on the lower surface of the second dielectric layer.

According to another aspect of the present invention, there is provided a plasma display panel comprising a lower substrate and an upper substrate spaced apart from each other by a predetermined distance, and forming a discharge space therebetween; a plurality of barrier ribs located between the lower substrate and the upper substrate and partitioning the discharge space to form a plurality of discharge cells; a plurality of address electrodes formed in parallel with one another on the upper surface of the lower substrate; a plurality of discharge electrodes formed at an angle to the address electrodes on the lower surface of the upper substrate; a fluorescent layer formed on the inner wall of the discharge cells; and an external light shielding member formed on the upper substrate, for preventing external light from entering the discharge cells, wherein the lower surface of the upper substrate has a plurality of convex lenses, to focus visible light generated in the discharge cells by discharge and emit the visible light to the outside.

The convex lenses may be aligned with each of the discharge cells.

The discharge electrodes may be formed from the lower surfaces of the convex lenses.

A transparent material layer may be formed to cover the lower surfaces of the convex lenses, and the discharge electrodes may be formed on the lower surface of the transparent material layer.

The external light shielding member may comprise a mask (preferably black) formed on the upper surface of the upper substrate. The mask may comprise a plurality of through holes through which the visible light generated in the discharge cells passes. It is preferable that the upper surface of the upper substrate exposed through the through holes be treated with a non-glare material. The mask may comprise a conductive film for shielding EMI.

BRIEF DESCRIPTION OF THE DRAWINGS

The above and other features and advantages of the present invention will become more apparent by describing in detail exemplary embodiments thereof with reference to the attached drawings in which.

In the drawings, it should be understood that like reference numbers refer to like features, structures and elements.

DETAILED DESCRIPTION OF EXEMPLARY EMBODIMENTS

Embodiments of the present invention will now be described more fully with reference to the accompanying drawings, in which exemplary embodiments of the invention are shown.

Figure 1:
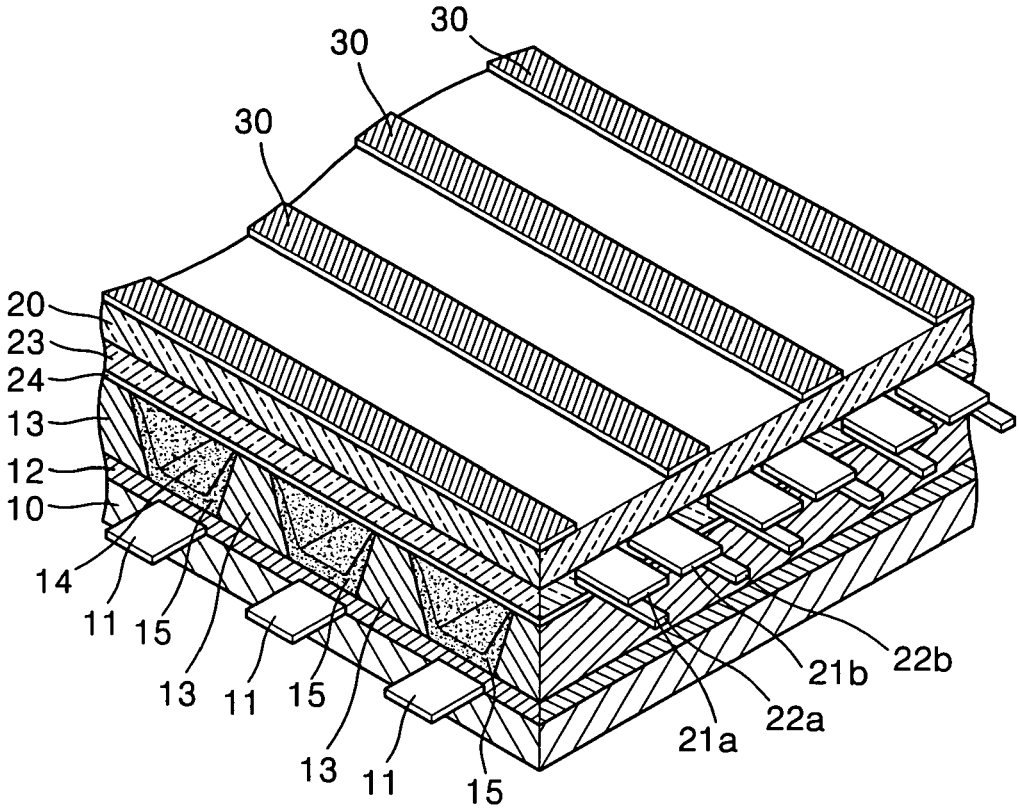
FIG. 1 (PRIOR ART)
FIG. 1 is a cutaway perspective view of a conventional surface discharge type PDP.
Figure 2:
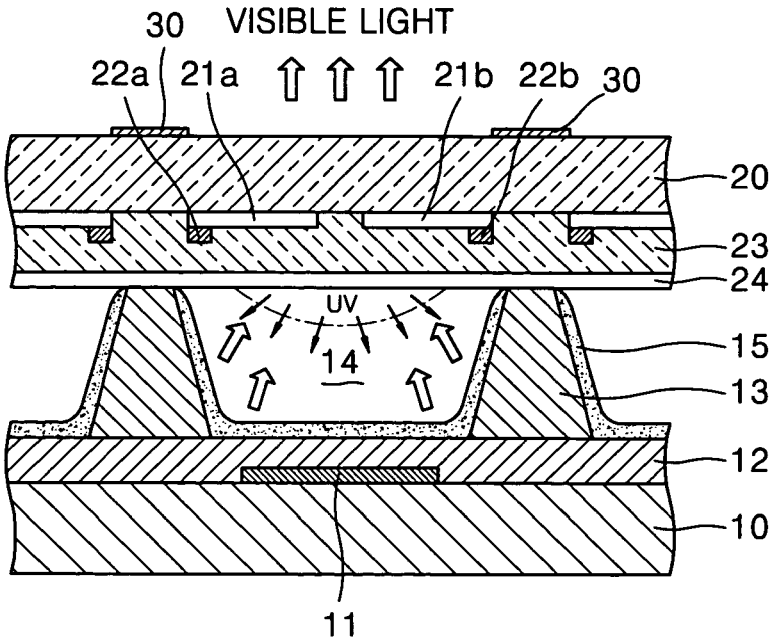
FIG. 2 (PRIOR ART)
FIG. 2 is a cross-sectional view illustrating the inner structure of the PDP of FIG. 1.
Figure 3:
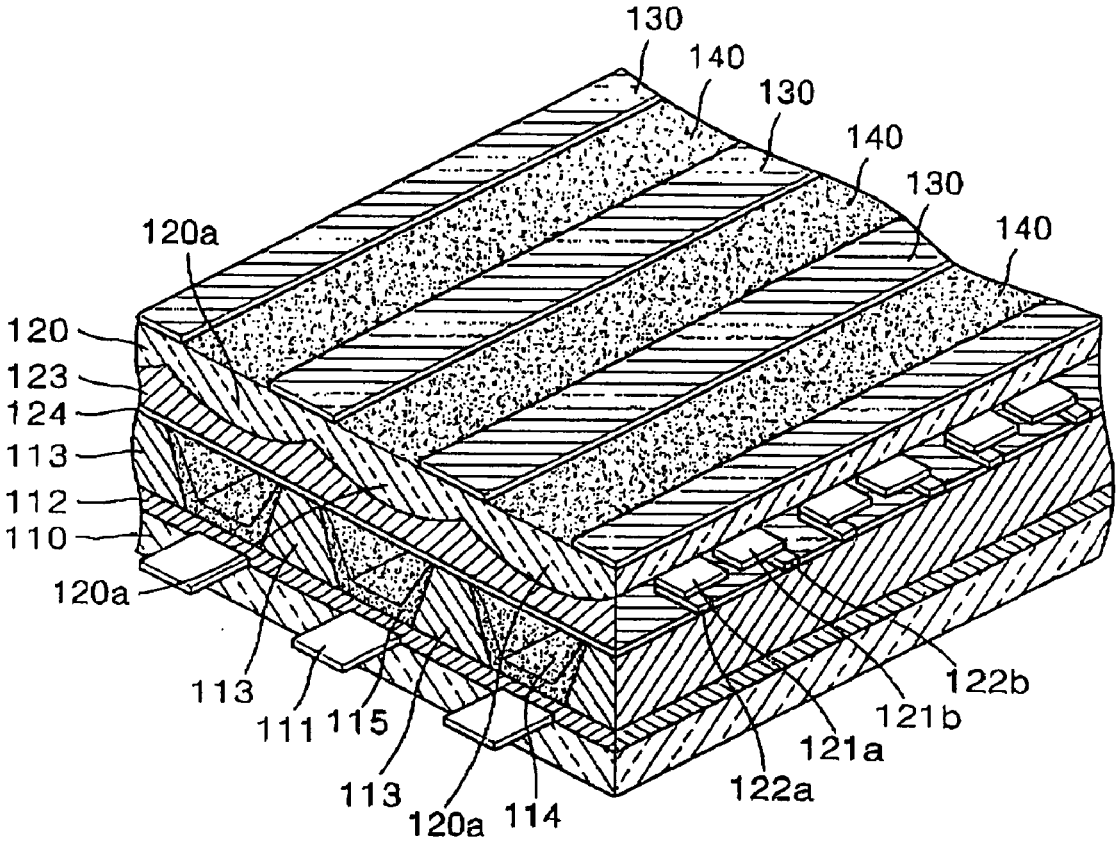
FIG. 3 is a cutaway perspective view of a PDP according to an embodiment of the present invention.
Figure 4:
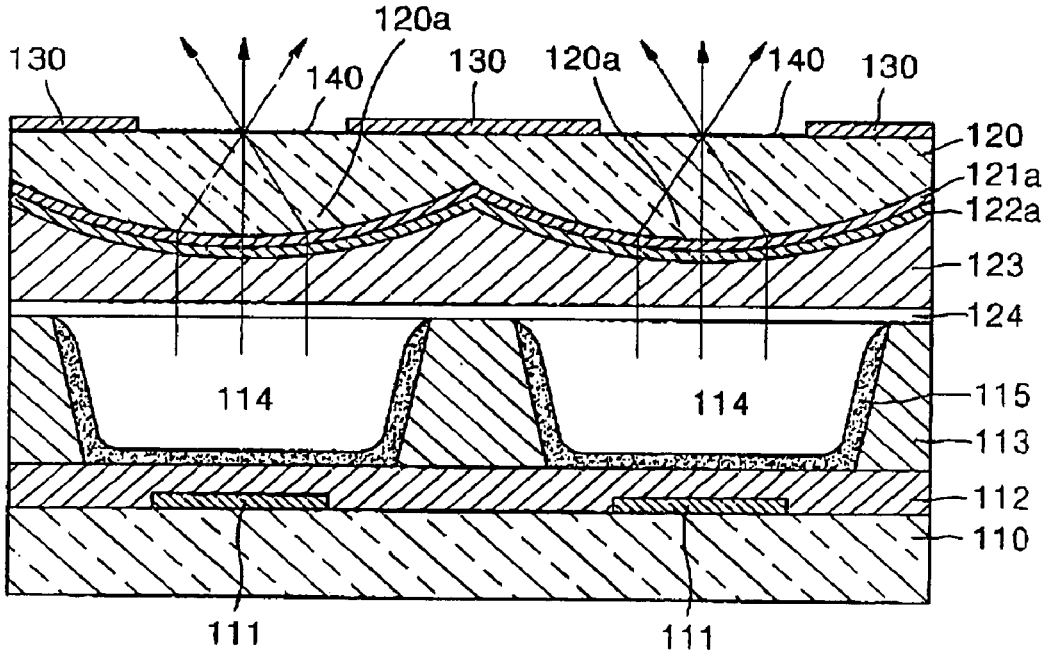
FIG. 4 is a cross-sectional view illustrating the inner structure of the PDP of FIG. 3.

FIG. 3 is a cutaway perspective view of a PDP according to an embodiment of the present invention, and FIG. 4 is a cross-sectional view illustrating the inner structure of the PDP of FIG. 3.

Referring to FIGS. 3 and 4, the PDP comprises a lower substrate 110 and an upper substrate 120, facing each other at a predetermined spacing. This space between the lower substrate 110 and the upper substrate 120 corresponds to a discharge space where plasma discharge occurs.

The lower substrate 110 is preferably formed of glass. A plurality of address electrodes 111 are formed in parallel with one another in a stripe configuration on the upper surface of the lower substrate 110. A first dielectric layer 112 is formed on the address electrodes 111 to cover the address electrodes 111 and the lower substrate 110. The first dielectric layer 112 can be formed by coating a dielectric material (preferably white) to a predetermined thickness.

A plurality of barrier ribs 113 are formed in parallel to the address electrodes 111 at a predetermined spacing, on the upper surface of the first dielectric layer 112. The barrier ribs 113 partition the discharge space between the lower substrate 110 and the upper substrate 120, thereby defining discharge cells 114. The barrier ribs 113 prevent electrical and optical cross-talk between adjacent discharge cells 114, thereby enhancing color purity. A red (R), green (G) and blue (B) fluorescent layer 115 is formed to a predetermined thickness on the upper surface of the first dielectric layer 112 and the sides of the barrier ribs 113 forming the inner walls of the discharge cells 114. The fluorescent layer 115 is excited by ultraviolet rays generated by plasma discharge, thereby emitting visible light of a certain color. The discharge cells 114 are filled with a discharge gas, which is a mixture of neon (Ne) and a small amount of xenon (Xe), as is generally used for plasma discharge.

The upper substrate 120 is transparent to visible light, and is mainly formed of glass. On the lower surface of the upper substrate 120 are formed a plurality of convex (preferably cylindrical) lenses 120*a*, parallel to the address electrodes 111. The size of the cylindrical lenses 120*a* corresponds to that of the discharge cells 114. These cylindrical lenses 120*a* focus visible light generated in the discharge cells 114 perpendicular to the address electrodes 111, and emit the visible light to the outside of the PDP. Thus, the cylindrical lenses 120*a* on the lower surface of the upper substrate 120, reduce the loss of visible light generated in the discharge cells 114, thereby enhancing the brightness of the PDP. It is preferable that the cylindrical lenses 120*a* are formed integral with the upper substrate 120, which can be achieved by processing the lower surface of the upper substrate 120.

On the lower surfaces of the cylindrical lenses 120*a*, first and second discharge electrodes 121*a* and 121*b* for sustaining discharge are formed in a pair for each discharge cell. The first and second discharge electrodes 121*a* and 121*b* are perpendicular to the address electrodes 111. The first and second discharge electrodes 121*a* and 121*b* are formed of a transparent conductive material such as indium tin oxide (ITO) in order to transmit visible light generated in the discharge cells 114. On the lower surfaces of the first and second discharge electrodes 121*a* and 121*b* are formed first and second bus electrodes 122*a* and 122*b*, which are preferably made of a metal. The first and second bus electrodes 122*a* and 122*b* decrease line resistance of the first and second discharge electrodes 121*a* and 121*b*, and are narrower than the first and second discharge electrodes 121*a* and 121*b*.

On the lower surfaces of the cylindrical lenses 120*a* is formed a second dielectric layer 123 covering the first and second discharge electrodes 121*a* and 121*b* and the first and second bus electrodes 122*a* and 122*b*. The second dielectric layer 123 can preferably be formed by coating a transparent dielectric material on the lower surface of the upper substrate 120 to a predetermined thickness.

A protective layer 124 is formed on the lower surface of the second dielectric layer 123. The protective layer 124 prevents the second dielectric layer 123 and the first and second discharge electrodes 121*a* and 121*b* from being damaged by plasma sputtering and emits secondary electrons, thereby lowering discharge voltage. The protective layer 124 can preferably be formed by coating magnesium oxide (MgO) on the lower surface of the second dielectric layer 123 to a predetermined thickness.

An external light shielding member is provided on the upper surface of the upper substrate 120 to prevent external light from entering the discharge cells 114 through the upper substrate 120. The external light shielding member is formed of a plurality of parallel stripes 130 on the upper surface of the upper substrate 120 at a predetermined spacing. The stripes 130 are of constant width and are parallel with the address electrodes 111 and the cylindrical electrodes 120*a*. The stripes 130 are formed where no visible light is emitted from the discharge cells 114, and are equidistant from the center lines of the cylindrical lenses 120*a*. Thus, when the stripes 130 are formed on the upper surface of the upper substrate 120, the visible light generated by the discharge cells 114 is focused onto the upper surface 140 of the upper substrate 120 as shown in FIG. 4, and are then diffused and emitted to the outside. Hence, since the stripes 130 can cover more of the upper surface of the upper substrate 120 than in the conventional PDP, external light can be more effectively excluded from the discharge cells 114. As a result, the bright room contrast of the PDP is enhanced. The stripes 130 may include a conductive film for shielding electromagnetic interference (EMI).

The upper surface 140 of the upper substrate 120 between the black stripes 130 is preferably treated with a non-glare material, to prevent external light from being reflected by the upper substrate 120 and dazzling a user's eyes.

In the PDP constructed as above, when an address discharge occurs between any one of the address electrodes 111 and the sustaining electrodes 121*a* and 121*b*, wall charges are formed. Thereafter, when an AC voltage is applied to the first and second discharge electrodes 121*a* and 121*b*, a sustaining discharge occurs inside the discharge cells 114 where the wall charges were formed. The sustaining discharge causes the discharge gases to generate ultraviolet rays, which excite the fluorescent layer 115 to generate visible light.

The visible light generated by the discharge cells 114 is focused onto the non-glare treated upper surface 140 of the upper substrate 120, and is then diffused and emitted to the outside of the PDP. This reduces the loss of visible light, thereby enhancing the brightness of the PDP.

Moreover, the ratio of the area of the stripes 130 to the area of the entire surface can be higher than in the conventional PDP, which enhances the bright room contrast of the PDP. In the conventional PDP, when the ratio of black stripes was at its upper limit of 50%, the bright room contrast is roughly 70:1. In a PDP according to an embodiment of the present invention, when the ratio of stripes was 60% and 70%, the bright room contrast is about 130:1 and 195:1, respectively. Also, when the ratio of black stripes was at the present embodiment's upper limit of 80%, the bright room contrast is about 300:1. Thus, a PDP according to an embodiment of the present invention can increase the bright room contrast to approximately four times that of the conventional PDP.

Figure 5:
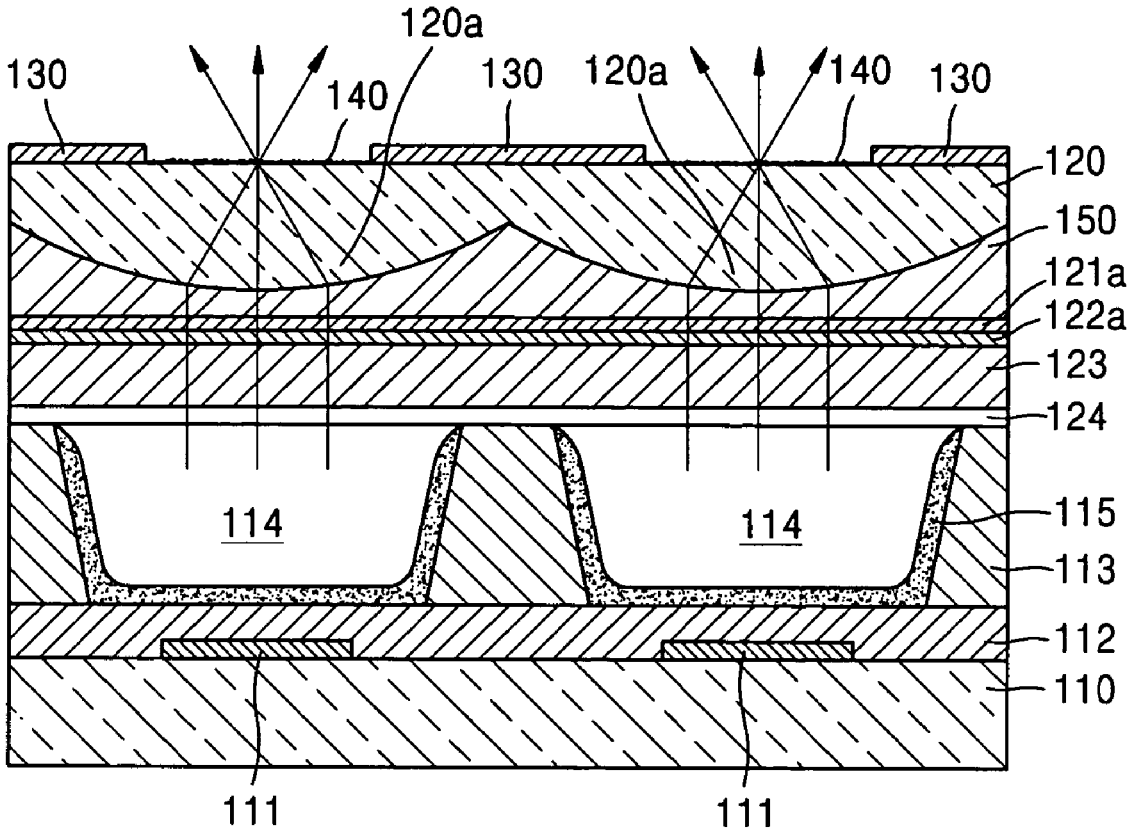
FIG. 5 is a cross-sectional view illustrating another embodiment of the PDP of FIG. 3.

FIG. 5 is a sectional view illustrating another modification of the PDP of FIG. 3. Referring to FIG. 5, a transparent material layer 150 is formed to cover the lower surfaces of the preferably cylindrical lenses 120*a*. First and second discharge electrodes 121*a* and 121*b* are formed on the flat lower surface of the transparent material layer 150. First and second bus electrodes 122*a* and 122*b* are formed on the lower surfaces of the first and second discharge electrodes 121*a* and 121*b*. Thus, the flat transparent material layer 150 aids in forming the first and second discharge electrodes 121*a* and 121*b* and the first and second bus electrodes 122*a* and 122*b*. Although, in the above description of an embodiment of the present invention, the lenses 120*a* were referred to as cylindrical lenses 120*a*, it should be understood that any suitable convex shaped lenses may be used.

Figure 6:
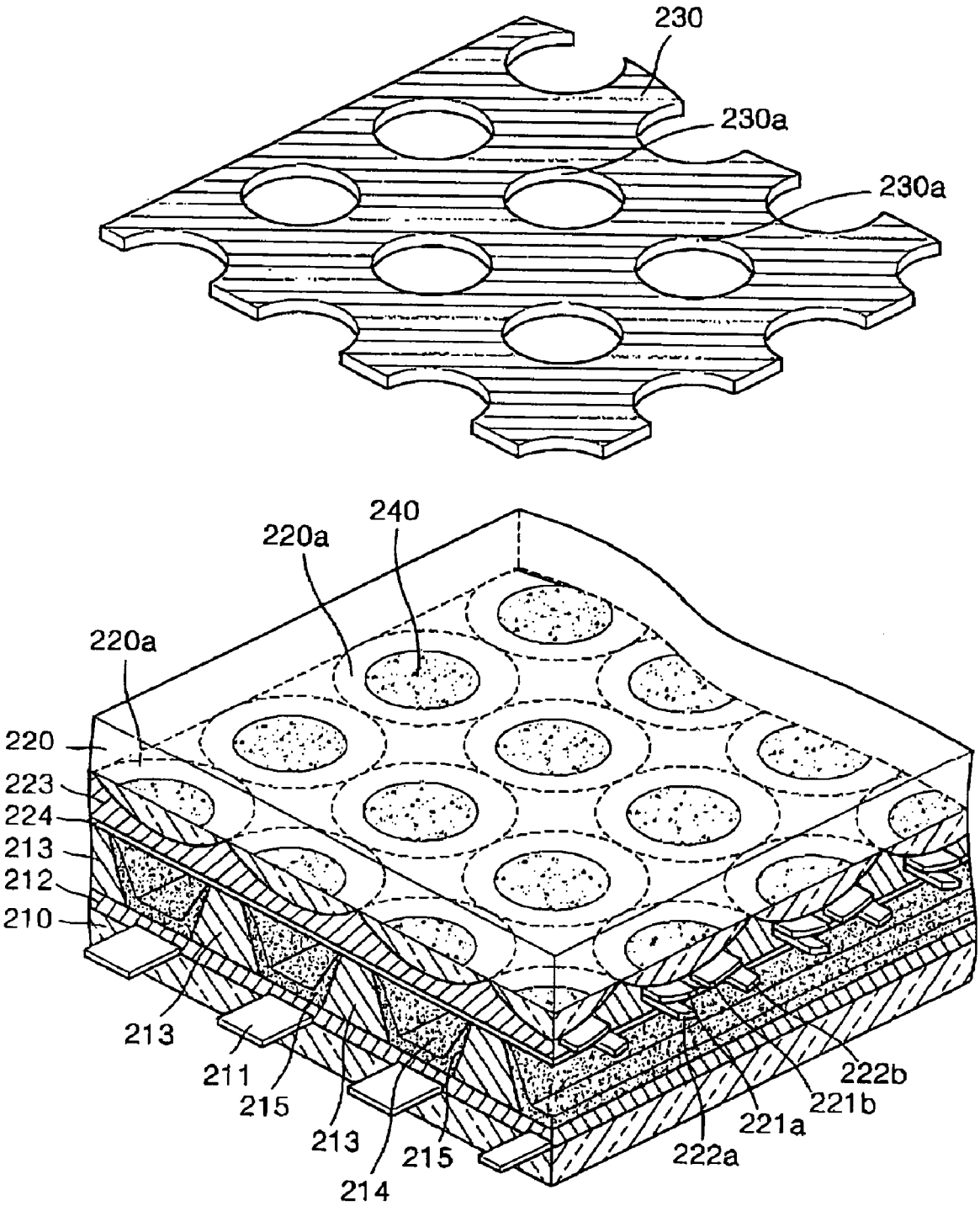
FIG. 6 is a cutaway perspective view of a PDP according to another embodiment of the present invention.
Figure 7A:
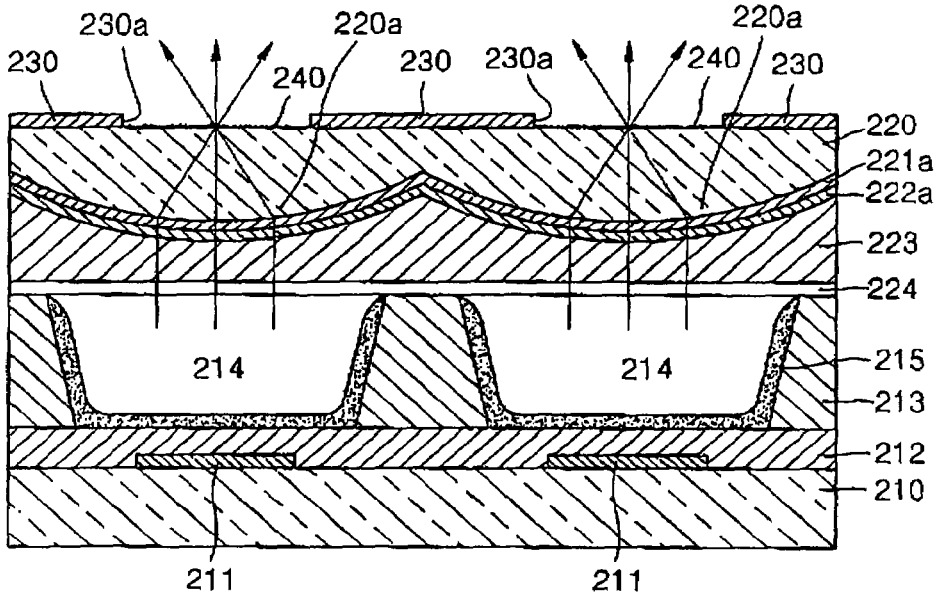
FIG. 7A is a cross-sectional view of the PDP of FIG. 6 taken perpendicular to the address electrodes.
Figure 7B:
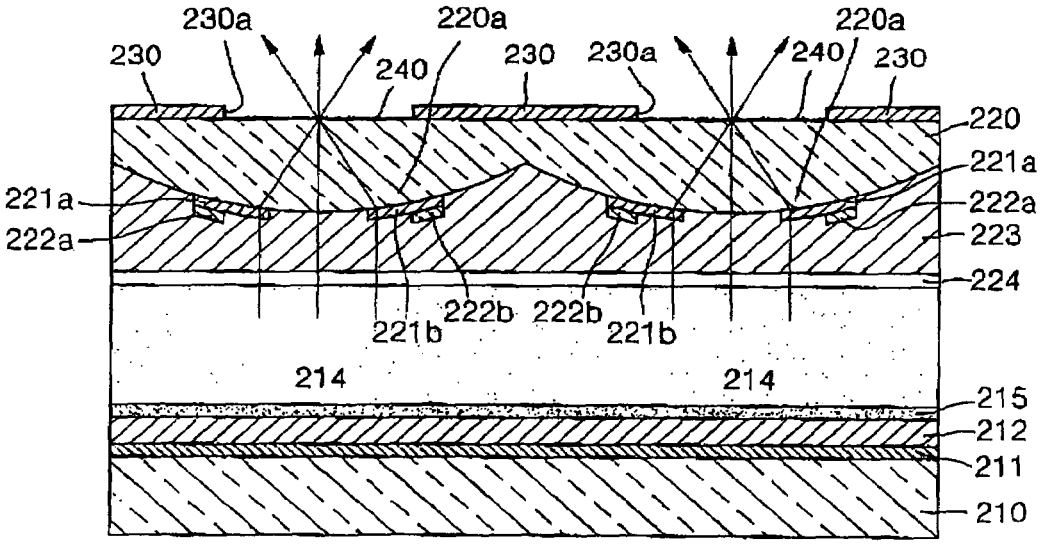
FIG. 7B is a cross-sectional view of the PDP of FIG. 6 taken parallel to the address electrodes.

FIG. 6 is a cutaway perspective view of a PDP according to another embodiment of the present invention, and FIGS. 7A and 7B are cross-sectional views of the PDP of FIG. 6 taken, respectively, perpendicular to and parallel to the address electrodes.

Referring to FIGS. 6, 7A and 7B, the PDP comprises a lower substrate 210 and an upper substrate, spaced apart from each other by a predetermined distance. A discharge space is formed between the lower substrate 210 and the upper substrate 220. On the lower substrate 210, a plurality of address electrodes 211 and a first dielectric layer 212 are formed. A plurality of barrier ribs 213 are formed parallel to the address electrodes 211 at a predetermined spacing on the first dielectric layer 212. The barrier ribs 213 partition the discharge space between the lower substrate 210 and the upper substrate 220, thereby defining discharge cells 214. A fluorescent layer 215 is formed on the upper surface of the first dielectric layer 212, and the side surfaces of the barrier ribs 213 forming inner walls of the discharge cells 214. The discharge cells 214 are preferably filled with a discharge gas.

A plurality of convex lenses 220*a* are formed on the lower surface of the upper substrate 220. The convex lenses 220*a* correspond respectively to the discharge cells 214. Each of the convex lenses 220*a* focuses visible light generated by the discharge cells 214 onto one point on the upper substrate 220, to emit the visible light out of the PDP. This reduces the loss of visible light, thereby enhancing the brightness of the PDP. It is preferable that the convex lenses 220*a* are formed integral with the upper substrate 220, which can be achieved by processing the lower surface of the upper substrate 220.

On the lower surfaces of the convex lenses 220*a*, first and second discharge electrodes 221*a* and 221*b* for sustaining discharge are formed in a pair for each discharge cell. The first and second discharge electrodes 221*a* and 221*b* are preferably formed perpendicular to the address electrodes 211. On the lower surface of the first and second discharge electrodes 221*a* and 221*b*, first and second bus electrodes 222*a* and 222*b*, which are preferably made of a metal, are formed.

A second dielectric layer 223 is formed on the lower surfaces of the convex lenses 220*a* to cover the first and second discharge electrodes 221*a* and 221*b* and the first and second bus electrodes 222*a* and 222*b*. A protective layer 224 is formed on the lower surface of the second dielectric layer 223.

An external light shielding member is provided on the upper surface of the upper substrate 220 to prevent external light from entering the discharge cells 214 through the upper substrate 220. The external light shielding member is formed of a mask 230 (preferably black) on the upper surface of the upper substrate 220. The mask 230 has a plurality of through holes 230*a* through which the visible light generated in the discharge cells 214 passes. The through holes 230*a* are preferably formed concentric with the convex lenses 220*a*. Also, the upper surface 240 of the upper substrate 220 exposed through the through holes 230*a* is preferably treated with a non-glare material. In the above PDP, when a discharge occurs, the visible light generated in the discharge cells 214 is focused on the non-glare treated upper surface 240 of the upper substrate 220 by the convex lenses 220*a* as shown in FIGS. 7A and 7B, and is diffused and emitted out of the PDP through the through holes 230*a* formed in the mask 230. Accordingly, the present embodiment can prevent external light from the discharge cells 214 more effectively than the conventional PDP, further enhancing the bright room contrast. Meanwhile, the mask 230 may comprise a conductive film for shielding electromagnetic interference (EMI).

Figure 8A:
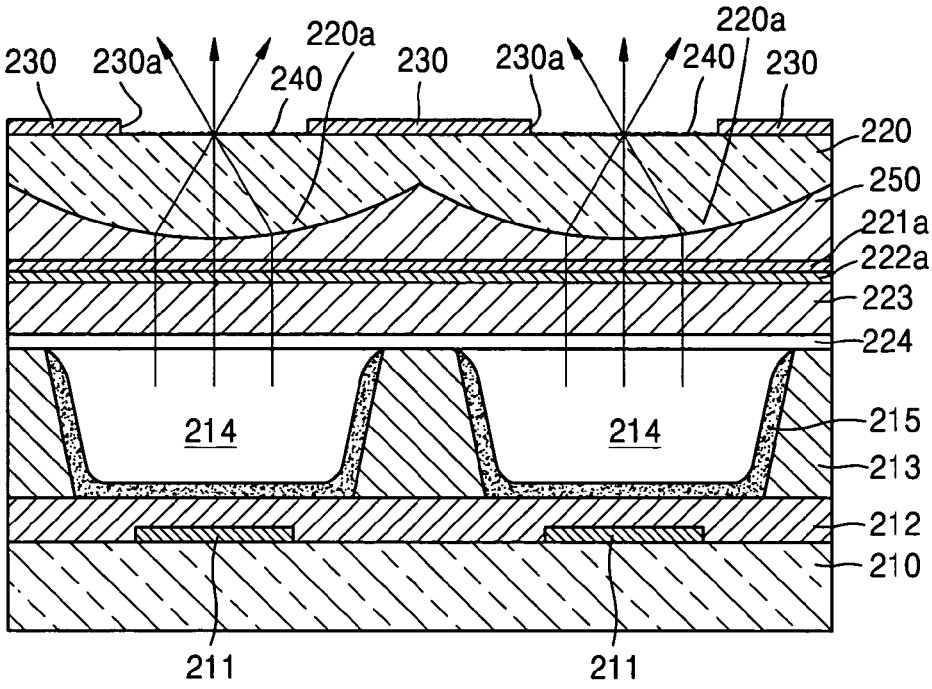
FIGS. 8A and 8B are cross-sectional views illustrating a PDP according to another embodiment of the present invention.
Figure 8B:
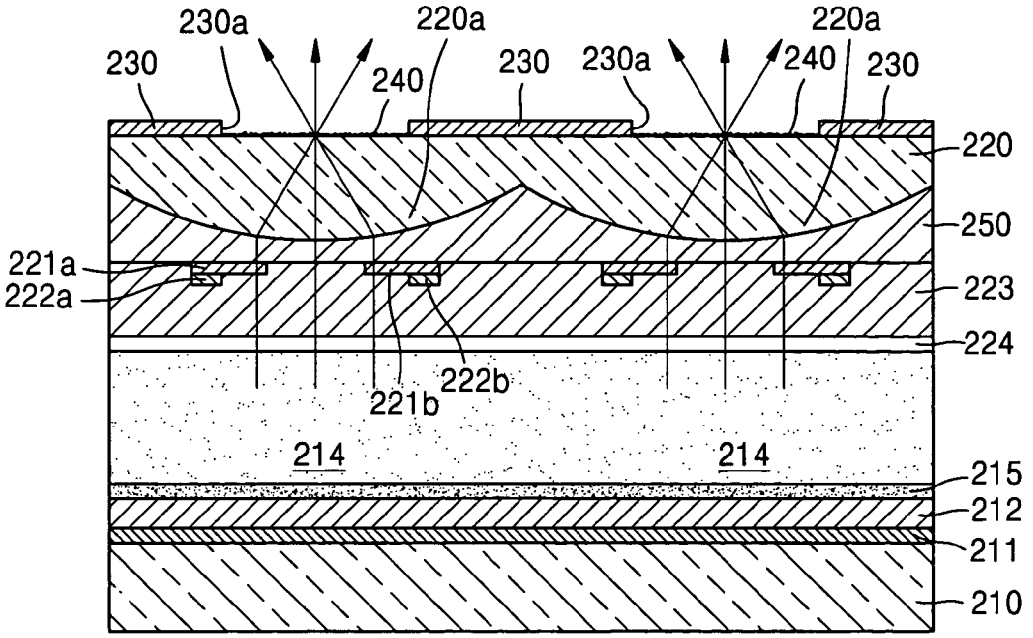

FIGS. 8A and 8B are sectional views of a PDP taken perpendicular to and parallel to the address electrodes 211, respectively, to illustrate a PDP according to another embodiment of the present invention.

Referring to FIGS. 8A and 8B, a transparent material layer 250 is formed to cover the lower surfaces of the convex lenses 220*a*. First and second discharge electrodes 221*a* and 221*b* are formed on the flat lower surface of the transparent material layer 250. First and second bus electrodes 222*a* and 222*b* are formed on the lower surfaces of the first and second discharge electrodes 221*a* and 221*b*. Thus, the flat transparent material layer 250 aids in forming the first and second discharge electrodes 221*a* and 221*b* and the first and second bus electrodes 222*a* and 222*b*.

As described above, the PDP according to the embodiments of the present invention has the following features:

First, a plurality of cylindrical or convex lenses are formed on the lower surface of the upper substrate, reducing the loss of visible light and enhancing the brightness of the PDP.

Second, preferably black stripes or a black mask can cover more area of the upper surface of the upper substrate than in the conventional PDP, thereby enhancing the bright room contrast of the PDP.

While the present invention has been particularly shown and described with reference to exemplary embodiments thereof, it will be understood by those of ordinary skill in the art that various changes in form and details may be made therein without departing from the spirit and scope of the present invention as defined by the following claims. For example, although the aforementioned embodiments show and describe an AC type surface discharge PDP, the present invention is not limited thereto but can also be applied to a DC type PDP or a facing discharge PDP.

What is claimed is:

1. A plasma display panel comprising:

a lower substrate and an upper substrate spaced apart by a predetermined distance to form a discharge space therebetween;

a plurality of barrier ribs between the lower substrate and the upper substrate, partitioning the discharge space to form a plurality of discharge cells;

a plurality of address electrodes formed in parallel on the upper surface of the lower substrate;

a plurality of discharge electrodes formed at an angle to the address electrodes on the lower surface of the upper substrate;

a fluorescent layer formed on the inner walls of the discharge cells; and an external light shielding member formed on the upper substrate, for preventing external light from entering the discharge cells, wherein the upper substrate has a plurality of cylindrical lenses, which are formed in parallel to the address electrodes on a lower surface thereof to focus visible light generated in the discharge cells by discharge and emit the visible light out of the plasma display panel.

2. The plasma display panel of claim 1, wherein the cylindrical lenses are formed integral with the upper substrate.

3. The plasma display panel of claim 1, wherein each of the cylindrical lenses is formed to a size corresponding to that of the discharge cells.

4. The plasma display panel of claim 1, wherein the discharge electrodes are formed on the lower surfaces of the cylindrical lenses.

5. The plasma display panel of claim 1, wherein a transparent material layer is formed to cover the lower surface of the cylindrical lenses.

6. The plasma display panel of claim 5, wherein the discharge electrodes are formed on the lower surface of the transparent material layer.

7. The plasma display panel of claim 1, wherein the external light shielding member comprises a plurality of stripes formed parallel to the address electrodes on an upper surface of the upper substrate.

8. The plasma display panel of claim 7, wherein the stripes are formed where no visible light is emitted in the discharge cells.

9. The plasma display panel of claim 7, wherein the stripes are equidistant to the center lines of the cylindrical lenses.

10. The plasma display panel of claim 7, wherein the stripes comprise a conductive film for shielding electromagnetic interference.

11. The plasma display panel of claim 7, wherein the upper surface of the upper substrate between the stripes is non-glare treated.

12. The plasma display panel of claim 1, wherein the barrier ribs are formed parallel to the address electrodes.

13. The plasma display panel of claim 1, wherein bus electrodes are formed on the lower surfaces of the discharge electrodes.

14. The plasma display panel of claim 1, wherein a first dielectric layer covering the address electrodes is formed on the upper surface of the lower substrate.

15. The plasma display panel of claim 14, wherein a second dielectric layer covering the discharge electrodes is formed on the lower surface of the upper substrate.

16. The plasma display panel of claim 15, wherein a protective layer is formed on the lower surface of the second dielectric layer.

17. A plasma display panel comprising:

a lower substrate and an upper substrate spaced apart by a predetermined distance to form a discharge space therebetween;

a plurality of barrier ribs between the lower substrate and the upper substrate for partitioning the discharge space to form a plurality of discharge cells;

a plurality of address electrodes formed in parallel on the upper surface of the lower substrate;

a plurality of discharge electrodes formed at an angle to the address electrodes on the lower surface of the upper substrate;

a fluorescent layer formed on the inner walls of the discharge cells; and an external light shielding member formed on the upper substrate for preventing external light from entering the discharge cells, wherein the upper substrate has a plurality of convex lenses, which are formed on the lower surface of the upper substrate to focus visible light generated in the discharge cells by discharge and emit the visible light out of the plasma display panel.

18. The plasma display panel of claim 17, wherein the convex lenses are formed integral with the upper substrate.

19. The plasma display panel of claim 17, wherein the convex lenses are formed corresponding to the discharge cells.

20. The plasma display panel of claim 17, wherein the discharge electrodes are formed on the lower surfaces of the convex lenses.

21. The plasma display panel of claim 17, wherein a transparent material layer is formed to cover the lower surfaces of the convex lenses.

22. The plasma display panel of claim 21, wherein the discharge electrodes are formed on the lower surface of the transparent material layer.

23. The plasma display panel of claim 17, wherein the external light shielding member comprises a mask formed on the upper surface of the upper substrate.

24. The plasma display panel of claim 23, wherein the mask comprises a plurality of through holes through which the visible light generated in the discharge cells passes.

25. The plasma display panel of claim 24, wherein the upper surface of the upper substrate exposed through the through holes is non-glare treated.

26. The plasma display panel of claim 23, wherein the mask comprises a conductive film for shielding EMI.

27. The plasma display panel of claim 17, wherein the barrier ribs are formed parallel to the address electrodes.

28. The plasma display panel of claim 17, wherein bus electrodes are formed on the lower surfaces of the discharge electrodes.

29. The plasma display panel of claim 17, wherein a first dielectric layer covering the address electrodes is formed on the upper surface of the lower substrate.

30. The plasma display panel of claim 29, wherein a second dielectric layer covering the discharge electrodes is formed on the lower surface of the upper substrate.

31. The plasma display panel of claim 30, wherein a protective layer is formed on the lower surface of the second dielectric layer.

* * * * *